US007338000B2

(12) United States Patent
Nilsson-Wulff et al.

(10) Patent No.: US 7,338,000 B2
(45) Date of Patent: Mar. 4, 2008

(54) SHELL FOR A GYRATORY CRUSHER AND A GYRATORY CRUSHER

(75) Inventors: Torbjörn Nilsson-Wulff, Svedala (SE); Christian Trulsson, Malmö (SE); Richard Bern, Svedala (SE); Björn Loven, Malmö (SE); Rolf Silfver, Beddingestrand (SE)

(73) Assignee: Sandvik Intellectual Property AB, Sandviken (SE)

( * ) Notice: Subject to any disclaimer, the term of this patent is extended or adjusted under 35 U.S.C. 154(b) by 114 days.

(21) Appl. No.: 11/378,632

(22) Filed: Mar. 20, 2006

(65) Prior Publication Data

US 2006/0219830 A1 Oct. 5, 2006

(30) Foreign Application Priority Data

Mar. 24, 2005 (SE) ..... 0500660

(51) Int. Cl.
*B02C 2/00* (2006.01)

(52) U.S. Cl. ..... 241/156; 241/207

(58) Field of Classification Search ..... 241/156, 241/207–216

See application file for complete search history.

(56) References Cited

U.S. PATENT DOCUMENTS 1,607,615 A * 11/1926 Greenfield ..... 241/156
1,692,161 A * 11/1928 Dormer et al. ..... 241/140
1,894,601 A 1/1933 Symons
2,065,821 A * 12/1936 Morch ..... 241/155
2,190,036 A * 2/1940 Morch ..... 241/156
2,291,992 A * 8/1942 Stearns ..... 241/156
4,566,638 A 1/1986 Lundin et al.
4,582,267 A 4/1986 Kohler
4,697,745 A 10/1987 Sewant et al.
2002/0088887 A1 7/2002 Davis et al.

FOREIGN PATENT DOCUMENTS

EP 0 567 077 B1 10/1997

* cited by examiner

*Primary Examiner*—Mark Rosenbaum
(74) *Attorney, Agent, or Firm*—Drinker Biddle & Reath LLP

(57) ABSTRACT

An inner shell, which is intended for use in a gyratory crusher and which during crushing will rotate around its own center axis in a first direction, has at least one additional crusher surface. The additional crusher surface has, in horizontal projection and as seen in the first direction, a decreasing distance to the center axis. Large objects can be introduced between the additional crusher surface and an outer shell near a first end of the additional crusher surface in order to, near a second end of the additional crusher surface, be squeezed between the additional crusher surface and the outer shell and be crushed.

20 Claims, 8 Drawing Sheets

VIa-VIa

VIb-VIb

VIc-VIc

SHELL FOR A GYRATORY CRUSHER AND A GYRATORY CRUSHER

This application claims priority under 35 U.S.C. § 119 to Swedish Patent Application No. 0500660-6, filed on Mar. 24, 2005, the disclosure of which is incorporated by reference herein in its entirety.

FIELD OF THE INVENTION

The present invention relates generally to an inner shell for use in a gyratory crusher, which inner shell is intended to be brought into contact with a material that is supplied at the upper portion of the crusher and is to be crushed, and that in a crushing gap crush the same material against an outer shell, wherein the inner shell during crushing will rotate around its own center axis in a first direction.

The present invention also relates generally to a gyratory crusher, which has an inner shell that is intended to be brought into contact with a material that is supplied at the upper portion of the crusher and is to be crushed, and that in a crushing gap crush the same material against an outer shell, wherein the inner shell during crushing will rotate around its own center axis in a first direction.

BACKGROUND OF THE INVENTION

In the crushing of hard material, e.g., stone blocks or ore blocks, materials are frequently crushed that have an initial size of, e.g., 300 mm or less to a size of, e.g., approx. 0-25 mm by means of a gyratory crusher. An example of a gyratory crusher is disclosed in U.S. Pat. No. 4,566,638. Said crusher has an outer shell that is mounted in a frame. An inner shell is fastened to a crushing head. The crushing head is fastened to a shaft, which at the lower end thereof is eccentrically mounted and which is driven by a motor. Between the outer and the inner shell, a crushing gap is formed into which material can be supplied. Upon crushing, the motor will get the shaft, and thereby the crushing head, to execute a gyratory pendulum motion, i.e., a motion during which the inner and the outer shell approach each other along a rotary generatrix and retreat from each other along another diametrically opposite generatrix.

It is a common problem upon crushing of hard materials by means of a gyratory crusher that a number of material pieces have a substantially larger size than what the desired crushing gap can accept. As a consequence, these pieces are not crushed but remain above the crushing gap and block materials having smaller grain size from coming down into the crushing gap and be crushed. As a result, blockages may arise, which entail a capacity reduction and that a manual cleaning has to be carried out. In practice, the consequence will frequently be that an unnecessary wide crushing gap has to be chosen so that even the large material pieces can come down into the crushing gap. However, this leads to a deteriorated size reduction of the supplied material and an unfavourable wear pattern of the shells.

SUMMARY OF THE INVENTION

It is an object of the present invention to provide an inner shell for use in the fine crushing in a gyratory crusher, which inner shell decreases or entirely eliminates the above-mentioned problems of the known technique.

This object is attained in an embodiment of the invention by an inner shell, which is of the kind mentioned by way of introduction and is characterized in that it has at least one additional crusher surface, which, in horizontal projection and as seen in the first direction, has a decreasing distance to a center axis and which at a first end, which is situated at the downstream end of the additional crusher surface in respect of the first direction, is situated at a first distance from the center axis, and at a second end, which is situated at the upstream end of the additional crusher surface in respect of the first direction, is situated at a second distance from the center axis, which second distance is greater than the first distance, in such a way that objects can be introduced between the additional crusher surface and the outer shell near the first end in order to, near the second end, be squeezed between the additional crusher surface and the outer shell and be crushed.

An advantage of this inner shell is that the inner shell can be adapted for optimum crushing of a supplied material that has a certain size distribution and also manage that a certain quantity of the supplied material has a considerably larger size than the average size. Thereby, a crusher, in which the inner shell according to an embodiment of the invention is installed, can tolerate that the supplied material is not entirely free from objects that actually are too large for the crushing gap in question. The crusher also gets a considerably larger span in which size distributions that can be accepted, which makes that the crusher can work with materials of varying size distribution without the shells needing to be replaced. The size reduction of the supplied material is improved, which makes that fewer crushing cycles are required for the provision of a certain size distribution of the final product. The fact that the additional crusher surface is located on the inner shell, which rotates, entails that no problems of ovality in the crushing gap arise.

According to an embodiment, the additional crusher surface extends, at least at the upper portion of the inner shell, around the circumference of the inner shell over an angle of at least 20°. This extension has turned out convenient in order to provide such nip angles and squeezing forces in the additional crusher surface that large objects are crushed efficiently. In case a plurality of additional crusher surfaces are utilized, each one should extend around the circumference of the inner shell over an angle of at least 20°.

In an embodiment, the additional crusher surface may be arched. An arched surface entails a good nip angle and an efficient squeezing of objects against the outer shell. According to an embodiment, the additional crusher surface has, in relation to the center axis of the inner shell, a bulging arc-shape. The bulging arc-shape gives a good nip angle and a good wear resistance, in such a way that the additional crusher surface also after a time of wear retains the function thereof.

In an embodiment, the inner shell may be provided with 1-8 additional crusher surfaces, each one of which, in horizontal projection and as seen in the first direction, has a decreasing distance to the center axis. At least 2 additional crusher surfaces make it possible to distribute the additional crusher surfaces symmetrically around the circumference of the inner shell, which decreases the risk of unbalances in the shell during operation. The more additional crusher surfaces, the greater the capacity to squeeze large objects into pieces. However, if the number of additional crusher surfaces becomes greater than 8, the additional crusher surfaces may obstruct supplied large objects from coming down fast into the crushing gap. If the inner shell has at least two additional crusher surfaces, these should suitably be symmetrically distributed along the circumference of the inner shell and preferably have the same design for the most efficient crushing of the large objects.

In an embodiment, the additional crusher surface may slope, as seen in vertical projection, at the upper portion thereof inward toward the center axis of the inner shell. An advantage of this is that the opening between the additional crusher surface and the outer shell becomes wider, which facilitates for supplied material to be led down into the crushing gap. The additional crusher surface may slope inward toward the center axis of the inner shell at an angle of 1-55°, more preferred 1-30°, to the vertical plane, at least at the upper portion thereof. These angles have turned out to entail appropriate nip angles, low wear and small obstacle for supplied material.

According to an embodiment, the inner shell has at least one shelf extending around the inner shell, a shoulder provided with the additional crusher surface being formed on the shelf. Formation of the additional crusher surface on the shelf is particularly advantageous in that objects that are too large to be supplied into the crushing gap will be accumulated on the shelves. The additional crusher surfaces will squeeze the objects into pieces and entail that these can be supplied into the crushing gap. According to an embodiment, the shelf is formed in the upper portion of the inner shell, which has the advantage that the shelf forms an intermediate storage for the supplied material, which is conditioned to the correct size by the additional crusher surface before it is supplied into the crushing gap.

According to another embodiment, the additional crusher surface extends along a height in the vertical direction that is at least 40% of the total height in the vertical direction along which crushing of material takes place against the inner shell. An advantage of this embodiment is that the additional crusher surface can contribute to the squeezing of large objects into pieces along a great part of the height of the inner shell. Thereby, the quantity of large objects that can be received increases without the capacity of the crusher decreasing appreciably. The difference between the first distance and the second distance may decrease gradually with increasing distance from the upper portion of the inner shell. An advantage of this is that the further down into the crusher that the supplied material comes, the more even size distribution it gets and the additional crusher surface can therefore gradually merge into the other crusher surfaces, which entails a more even load on the crusher.

In an embodiment, the additional crusher surface forms a transition between a first circumference portion, which on each height level has a constant distance to the center axis, which distance is equal to the distance of the additional crusher surface at the first end to the center axis on the respective level, and a second circumference portion, which on each height level has a constant distance to the center axis, which distance is equal to the distance of the additional crusher surface at the second end to the center axis on the respective level. Thereby, the crushing gap can be divided into a narrow crushing chamber and a wide crushing chamber by the fact that the inner shell is provided with an outer crusher surface and an inner crusher surface. The additional crusher surface forms a transition between the inner crusher surface and the outer crusher surface and contributes to the squeezing of large objects into pieces, which are supplied in the wide crushing chamber, in such a way that these can be crushed further in the narrow crushing chamber.

In an embodiment, the second distance may be 5-30% greater than the first distance, at least in the upper portion of the shell. A second distance more than 30% greater than the first distance may entail great mechanical loads on the crusher when very large objects are squeezed between the additional crusher surface and the outer shell. A second distance less than 5% greater than the first distance may entail that the additional crusher surface gets a very limited effect on the large objects.

It is also an object of the present invention to provide a gyratory crusher, which gyratory crusher is less sensitive to the size distribution of supplied material than the known crushers.

This object is attained in an embodiment of the invention by a gyratory crusher that is of the above-mentioned kind and characterized in that the inner shell has at least one additional crusher surface, which, in horizontal projection and as seen in the first direction, has a decreasing distance to the center axis and which at a first end, which is situated at the downstream end of the additional crusher surface in respect of the first direction, is arranged to form a first shell distance to the outer shell, and at a second end, which is situated at the upstream end of the additional crusher surface in respect of the first direction, is arranged to form a second shell distance to the outer shell, which second shell distance is less than the first shell distance, so that objects can be introduced between the additional crusher surface and the outer shell at the first end in order to, at the second end, be squeezed between the additional crusher surface and the outer shell and be crushed. A gyratory crusher of this type has, among other things, the advantage that it can be adapted for optimum crushing of a supplied material that has a certain size distribution and also manage that certain objects have a considerably larger size than the average size.

According to an embodiment, the inner shell has at least one shelf extending around the inner shell, a shoulder provided with the additional crusher surface being formed on the shelf, the second shell distance being 10-60% of the first shell distance. A gyratory crusher having shells of this type is very convenient for fine crushing, i.e., the crushing of a material that initially is relatively fine-grained.

According to another embodiment, the additional crusher surface extends along a height in the vertical direction that is at least 40% of the total height in the vertical direction along which crushing of material takes place against the inner shell, the second shell distance being 40-90% of the first shell distance on a level with the upper portion of the inner shell. A gyratory crusher having shells of this type is very convenient for the crushing of a material the size distribution of which may vary within wide limits, i.e., the crushing of a material that is not well-defined in respect of the size distribution.

In an embodiment, the additional crusher surface forms, seen in a radially vertical plane and on a certain level in the vertical direction, an angle of 1-30° with the crusher surface of the outer shell on the same level. An angle larger than 30° may entail a risk that objects are not squeezed in between the additional crusher surface and the outer shell and thereby are not crushed in the desired way. An angle less than 1° means that it may be more difficult for material to come down fast between the additional crusher surface and the outer shell.

BRIEF DESCRIPTION OF THE DRAWINGS

The accompanying drawings, which are incorporated herein and constitute part of this specification, illustrate the presently preferred embodiments of the invention, and together with the general description given above and the detailed description given below, serve to explain features of the invention.

DETAILED DESCRIPTION OF THE PREFERRED EMBODIMENTS

Figure 1:
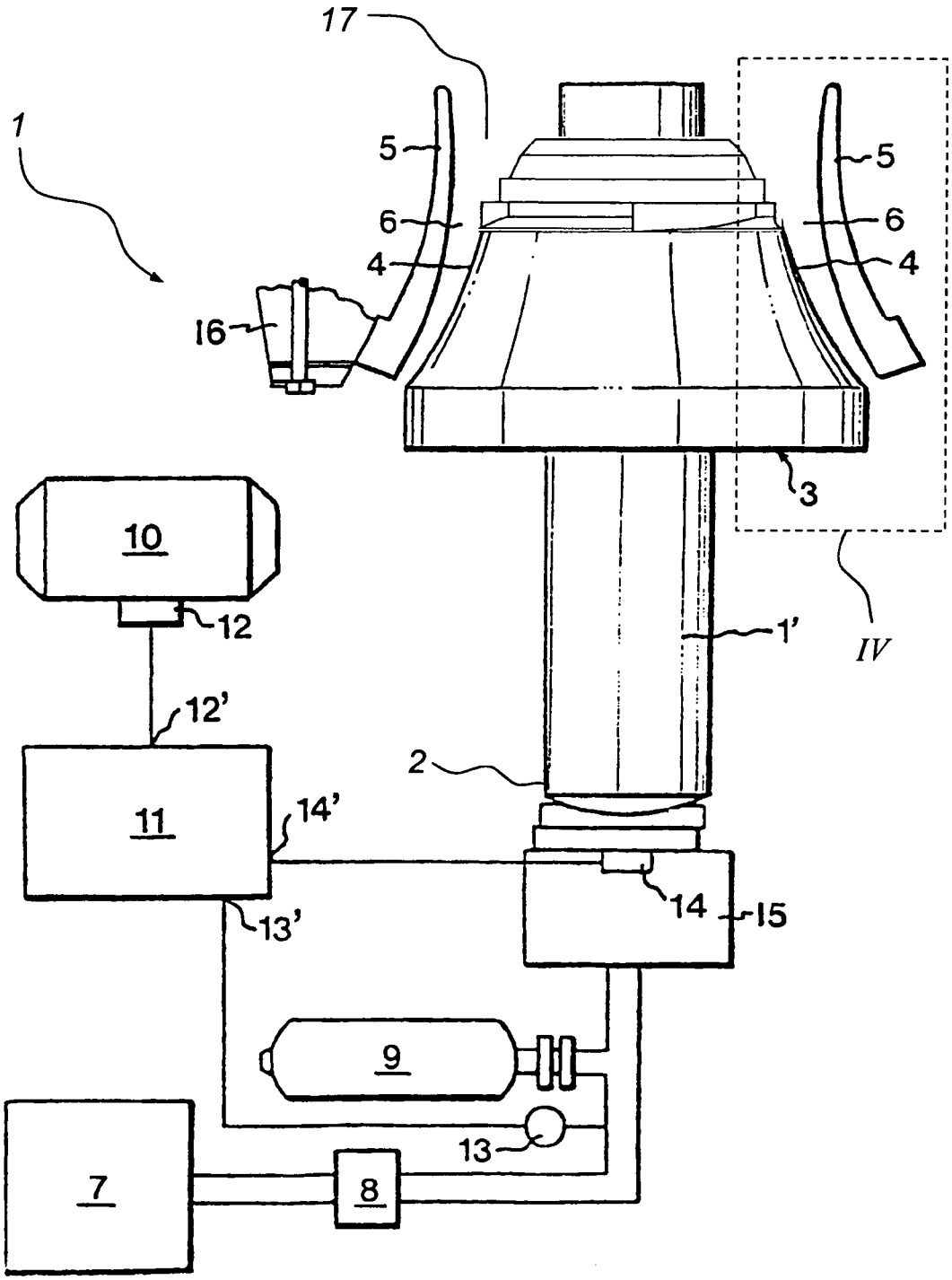
FIG. 1 schematically shows a gyratory crusher having associated driving, setting and control devices.

In FIG. 1, a gyratory crusher 1 for fine crushing is schematically shown, which crusher is intended for the greatest possible size reduction of a supplied material. The crusher 1 has a shaft 1', which at the lower end 2 thereof is eccentrically mounted. At the upper end thereof, the shaft 1' carries a crushing head 3. The crushing head 3 has a first, inner, crushing shell 4. In a machine frame 16, a second, outer, crushing shell 5 has been mounted in such a way that it surrounds the inner crushing shell 4. Between the inner crushing shell 4 and the outer crushing shell 5, a crushing gap 6 is formed, which in axial section, as is shown in FIG. 1, has a decreasing width in the downward direction. The shaft 1', and thereby the crushing head 3 and the inner crushing shell 4, is vertically movable by means of a hydraulic setting device, which comprises a tank 7 for hydraulic fluid, a hydraulic pump 8, a gas-filled container 9 and a hydraulic piston 15. Furthermore, a motor 10 is connected to the crusher, which motor during operation of the crusher 1 is arranged to bring the shaft 1', and thereby the crushing head 3, to execute a gyratory motion, i.e., a motion during which the two crushing shells 4, 5 approach each other along a rotary generatrix and retreat from each other at a diametrically opposite generatrix.

In operation, the crusher is controlled by a control device 11, which, via an input 12', receives input signals from a transducer 12 arranged at the motor 10, which transducer measures the load on the motor 10, via an input 13' receives input signals from a pressure transducer 13, which measures the pressure in the hydraulic fluid in the setting device 7, 8, 9, 15, and via an input 14' receives signals from a level transducer 14, which measures the position of the shaft 1' in the vertical direction in relation to the machine frame 16.

Thus, at the upper portion 17 of the crusher 1, a material is supplied, which then is crushed in the crushing gap 6 between the inner shell 4 and the outer shell 5 into decreasingly sizes while the material moves downward through the crushing gap 6.

Figure 2A:
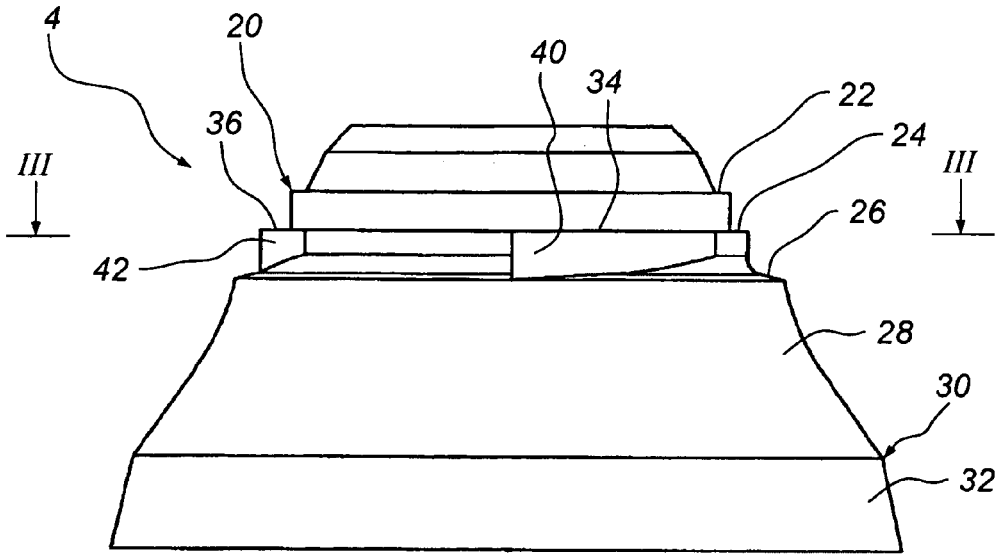
FIG. 2*a* is a side view and shows an inner shell according to a first embodiment of the present invention.
Figure 2B:
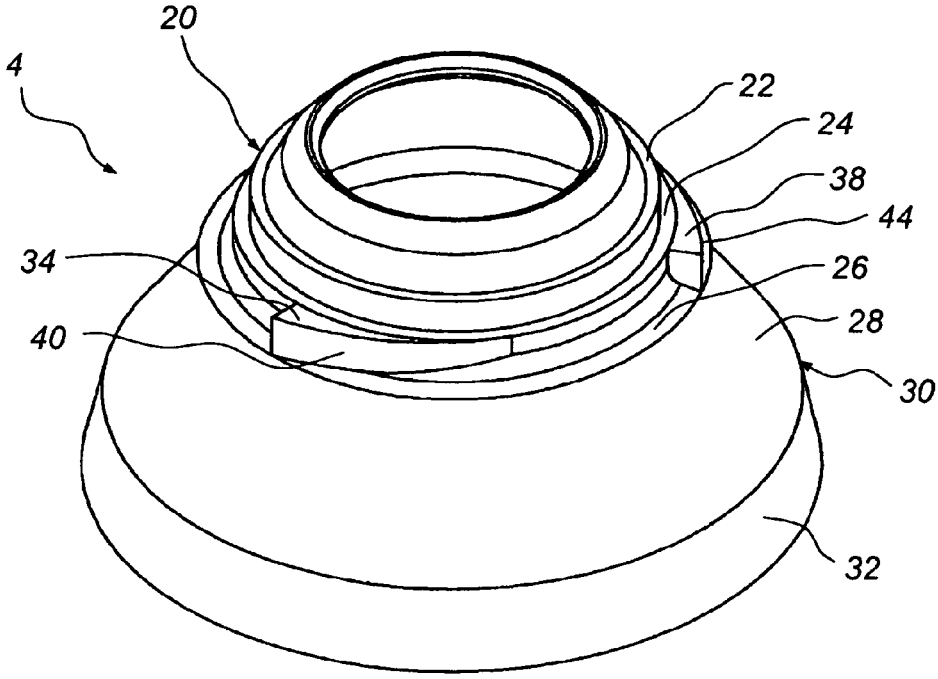
FIG. 2*b* is a perspective view and shows the shell shown in FIG. 2*a* seen obliquely from above.
Figure 2C:
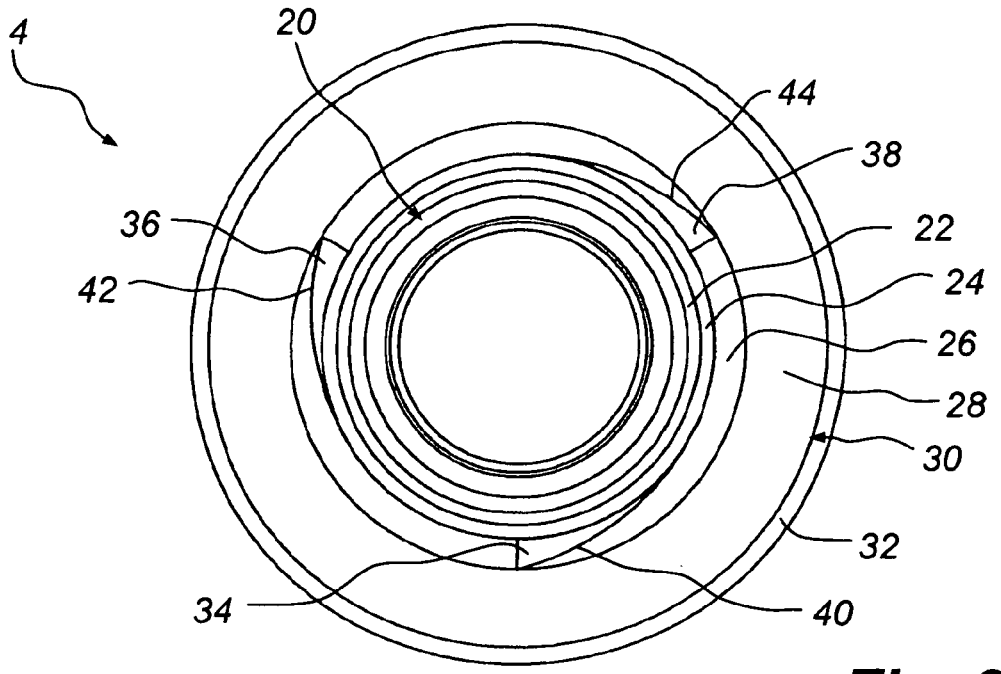
FIG. 2*c* is a top view and shows the shell shown in FIG. 2*a* seen straight from above.

FIG. 2*a*-2*c* shows the inner shell 4 seen from the side, seen in perspective obliquely from above, as well as seen straight from above. The same inner shell 4 is useful in fine crushing, i.e., when the supplied material has a size of typically approx. 30-80 mm and the finished crushed product is intended to have a size of approx. 0-25 mm. At the upper portion 20 thereof, the shell has 4 an upper, first shelf 22, an intermediate, second shelf 24 and a lower, third shelf 26 on which shelves 22, 24, 26 material can rest before it is supplied into the crushing gap 6. Thus, the three shelves 22, 24, 26 form a buffer stock where supplied material is collected before it is led further into the crushing gap 6. The shelves 22, 24, 26 are, as is seen in FIG. 2*a*, substantially horizontal, but may slope as much as 45° to the horizontal plane. Underneath the third shelf 26, the actual crusher surface 28 begins where the principal crushing of the material takes place. After the crusher surface 28, in the lower portion 30 of the shell 4, a chamfered surface 32 trails along which crushed material slides out of the crusher 1 to be possible to be fed out subsequently.

The third shelf 26 carries three shoulders 34, 36, 38, each of which carries an additional crusher surface 40, 42 and 44, respectively, i.e., the shell 4 has totally three additional crusher surfaces 40, 42, 44 in addition to the crusher surface 28. The additional crusher surfaces 40, 42, 44 are symmetrically distributed along the circumference of the inner shell 4, which among other things is seen FIG. 2*c*.

Figure 3:
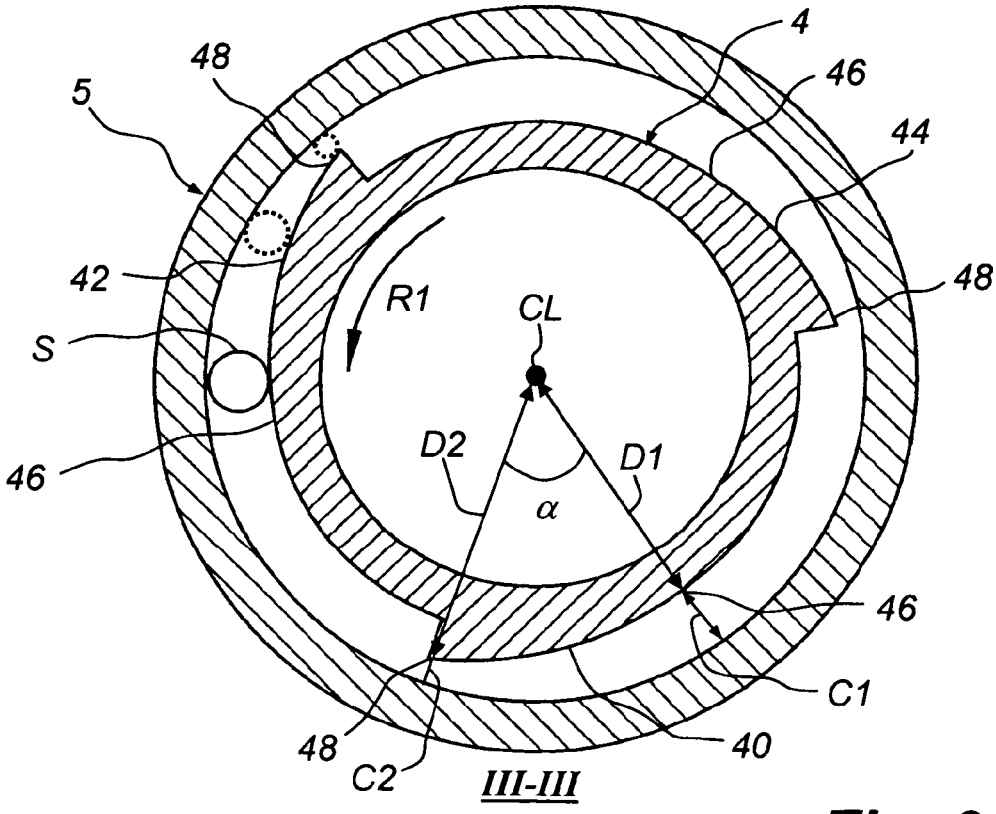
FIG. 3 is a section view in the horizontal plane and shows the inner shell shown in FIG. 2*a* in the section III-III as well as an outer shell.

FIG. 3 shows the inner shell 4 seen in the section III-III in FIG. 2*a*. For reasons of clarity, no subjacent structures are shown but only the structures that are in the proper section III-III. As is seen in FIG. 3, also the outer shell 5 is shown as seen in cross-section on the same level as the inner shell 4. It will be appreciated that the inner shell 4 during crushing will describe a gyrating motion and will therefore in each moment have an eccentric position in relation to the outer shell 5, something that for reasons of clarity is not shown in the drawings. The design of and the function of the additional crusher surface 40 will now be described in more detail. An arrow shows how the inner shell 4, during crushing, will rotate in a first direction R1 around its own center axis CL. This rotation in the first direction R1 is the result of the rolling, via material that is to be crushed, against the outer shell 5 that is caused by the motor 10 bringing the lower end 2 of the shaft 1' to gyrate in a second direction, which is opposite to the first direction R1. The additional crusher surface 40 has, in the horizontal projection shown in FIG. 3 and as seen in the first direction R1, a decreasing distance to the center axis CL. A first end 46 situated on the additional crusher surface 40, which end is situated in the downstream end in respect of the first direction R1, has a first distance D1 to the center axis CL. A second end 48 situated on the additional crusher surface 40, which end is situated in the upstream end in respect of the first direction R1, has a second distance D2 to the center axis CL, which second distance D2 is approx. 12% greater than the first distance D1. Thereby, on the level shown in FIG. 3, during crushing, the crusher 1 will have a first shell distance C1 occurring between the inner shell 4, at the first end 46 of the additional crusher surface 40, and the outer shell 5 that is approx. three times as large as a second shell distance C2 occurring between the inner shell 4, at the second end 48 of the additional crusher surface 40, and the outer shell 5. The shell distances C1 and C2 relate to distances that have been measured in the respective points on the shell 4 when the respective point is in a neutral position. Neutral position for a point on the inner shell 4, in which point the shell distance C1 and C2, respectively, are measured, relates to a position where the point is halfway between the position where the point on the inner shell 4 by virtue of the gyrating motion is as closest to the outer shell 5 and the position where the point on the inner shell 4 by virtue of the gyrating motion is as farthest from the outer shell, i.e., the measures C1, C2 apply in an imaginary position where the center axis CL of the inner shell 4 coincides with the center axis of the outer shell 5, as is shown in FIG. 3. The additional crusher surface 40 extends around the circumference of the inner shell 4 over an angle of approx. 60°, i.e., the angle α shown in FIG. 3 is approx. 60°. The additional crusher surface 40 is arched and has more precisely a bulging arc-shape in relation to the center axis CL of the shell 4, as seen in the horizontal projection shown in FIG. 3.

Figure 4:
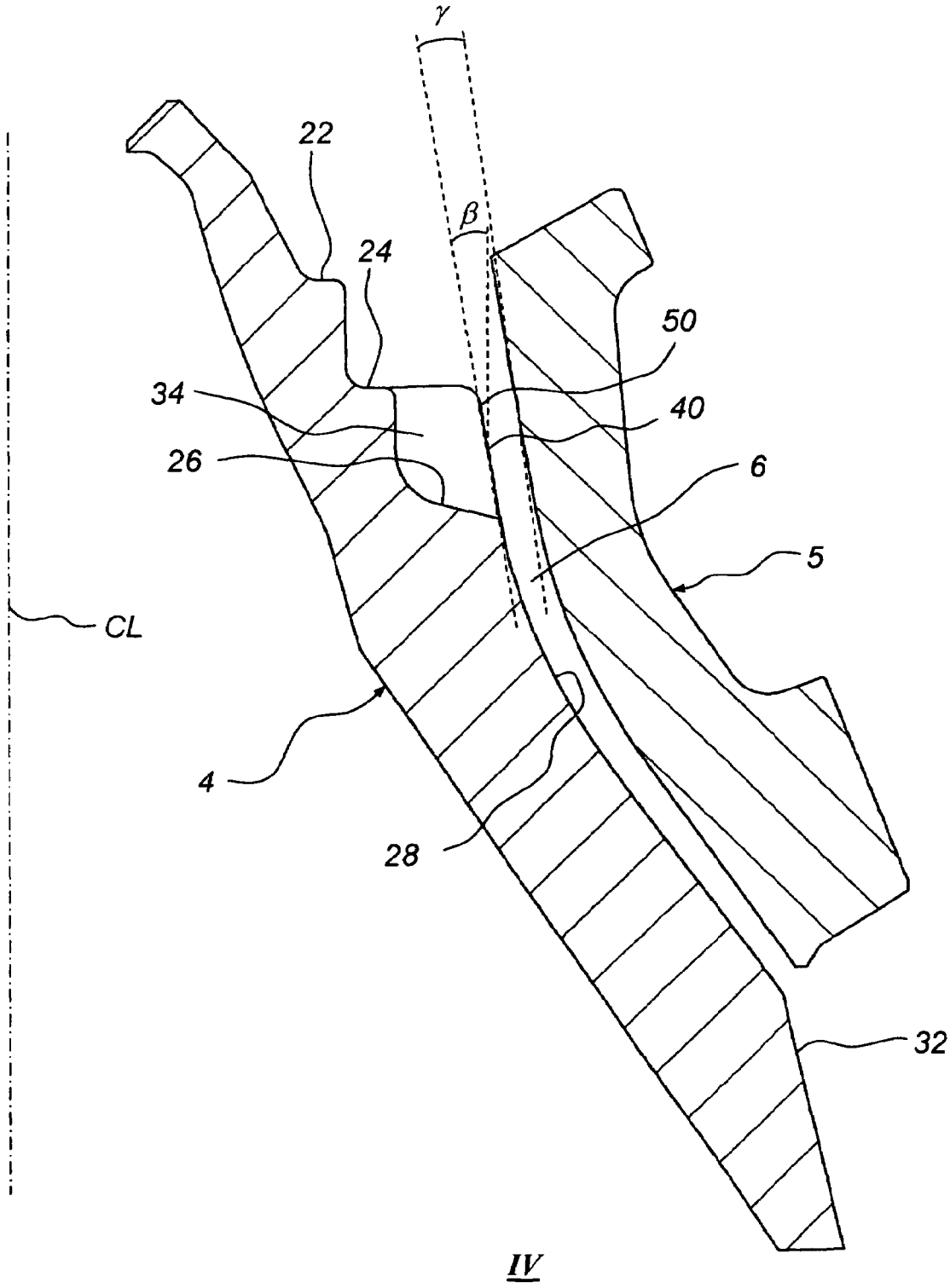
FIG. 4 is a sectional view in the vertical plane and shows the inner shell and the outer shell as seen in the section IV in FIG. 1.

In FIG. 4, the inner shell 4 and the outer shell 5 are shown as seen in the section IV shown in FIG. 1, i.e., in a section in vertical projection. As is seen in FIG. 4, at the upper portion 50 thereof the additional crusher surface 40 slopes inward toward the center axis CL. In that connection, the additional crusher surface 40 forms an angle β with the vertical plane of approx. 10°. The additional crusher surface 40 forms, as seen in a radially vertical plane according to FIG. 4 and on a certain level in the vertical direction, an angle γ with the crusher surface of the outer shell 5 on the same level. On the level that is shown in FIG. 4, the angle γ is 3°.

The additional crusher surfaces 42 and 44 have the same design as the additional crusher surface 40 described above.

The function of the additional crusher surfaces 40, 42, 44 during crushing will now be described closer, reference being made in particular to FIG. 3, in which a stone block S is schematically shown. The stone block S is too large to be allowed to be supplied down into the crushing gap 6, which is best seen in FIG. 1, and will therefore land on the third shelf 26. Thanks to the rolling, which causes rotation of the inner shell 4 in the first direction R1, the additional crusher surface 42 will travel along the stone block S in such a way that this is subjected to a thinner and thinner cross section from the first end 46 of the additional crusher surface 42 to the second end 48. The thinner and thinner cross section entails that the stone block S eventually is squeezed against the outer shell 5 into pieces, indicated by dashed circles in FIG. 3, which are so small that they can pass down into the crushing gap 6.

Thus, the additional crusher surfaces 40, 42, 44 entail that a supplied material, which contains a few stone blocks that are too large for the crushing gap 6, yet can be crushed in the crusher without any accumulation of the too large stone blocks taking place on the shelves 22, 24, 26. The arc-shape of the additional crusher surfaces 40, 42, 44, in combination with each additional crusher surface's 40, 42, 44 large extension over the circumference of the shell, i.e., the large angle α, has the advantage that the nip angles become advantageous, which decreases the risk that a stone block is pushed in front of the additional crusher surface 40, 42, 44 instead of being supplied inward toward the second end 48 and be squeezed into pieces. The angle β of the additional crusher surface 40, 42, 44, as seen in vertical projection, has also the purpose of forming an appropriate nip angle. An additional advantage of the additional crusher surface 40, 42, 44 at the upper portion thereof 50 sloping inward toward the center axis CL is that the crushing gap 6 thereby will not become unnecessary narrow at the upper portion thereof.

Figure 5A:
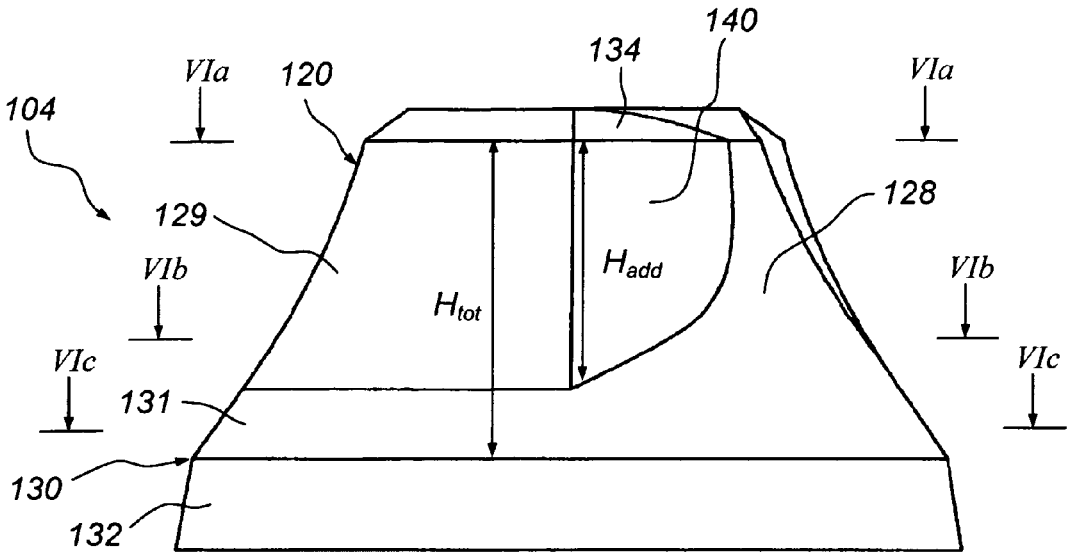
FIG. 5*a* is a side view and shows an inner shell according to a second embodiment of the present invention.
Figure 5B:
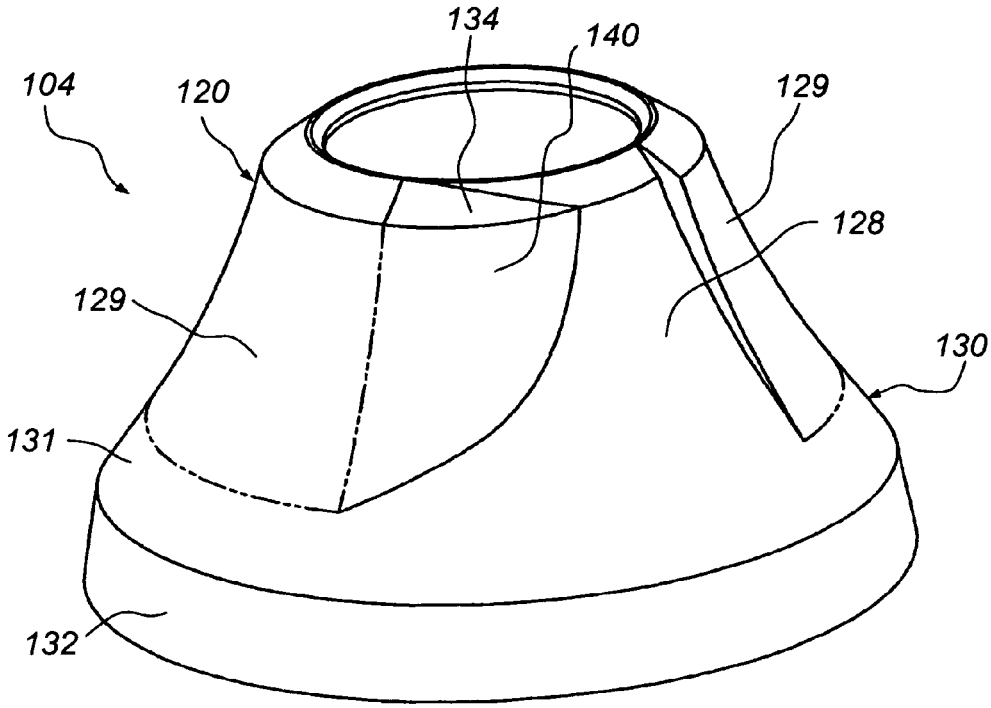
FIG. 5*b* is a perspective view and shows the shell shown in FIG. 5*a* seen obliquely from above.
Figure 5C:
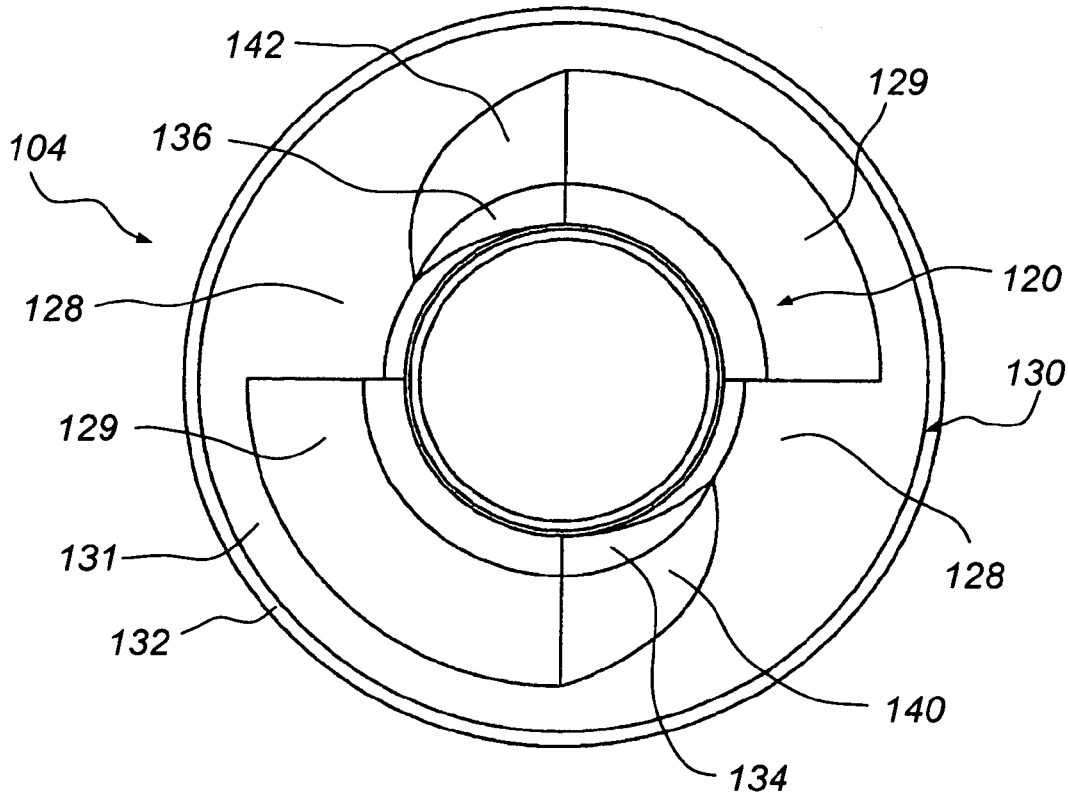
FIG. 5*c* is a top view and shows the shell shown in FIG. 5*a* seen straight from above.

FIGS. 5*a*-5*c* show an inner shell 104, according to a second embodiment of the invention, seen from the side, seen in perspective obliquely from above, as well as seen straight from above. This inner shell 104 is useful when the supplied material has a size that may vary within a wide interval of typically approx. 100-300 mm and the finished crushed product is intended to have a size of approx. 0-90 mm. At the upper portion 120 thereof, the shell 104 has two inner crusher surfaces 128 and two outer crusher surfaces 129, which are situated between the inner crusher surfaces 128. At the lower portion 130 thereof, the inner shell 104 has a chamfered surface 132 along which crushed material slides out of the crusher to be possible to be fed out subsequently. Immediately above the chamfered surface 132, the shell 104 has a lower crusher surface 131.

At the upper portion 120 thereof, the inner shell 104 has two shoulders 134, 136 each of which carries an additional crusher surface 140 and 142, respectively, i.e., the shell 104 has two additional crusher surfaces 140, 142 in addition to the crusher surfaces 128, 129, 131. The additional crusher surfaces 140, 142 are symmetrically distributed along the circumference of the inner shell 104, which among other things is seen in FIG. 5*c*. The additional crusher surface 140 extends, as is seen in FIG. 5*a*, along a height $H_{add}$ in the vertical direction that is approx. 80% of the total height $H_{tot}$, in the vertical direction along which crushing of material takes place against the inner shell 104. Thereby, the additional crusher surface 140 will crush large objects not only closest to the upper portion 120 but along a great part of the total height $H_{tot}$, which allows a relatively large share of large objects to be crushed. By means of the inner shell 104, the size reduction is increased due to the fact that a great part of the fine material is crushed in a thinner crushing gap, and a more favourable wear pattern of the inner shell 104 as well as on an outer shell against which the inner shell 104 crushes objects is also provided.

Figure 6A:
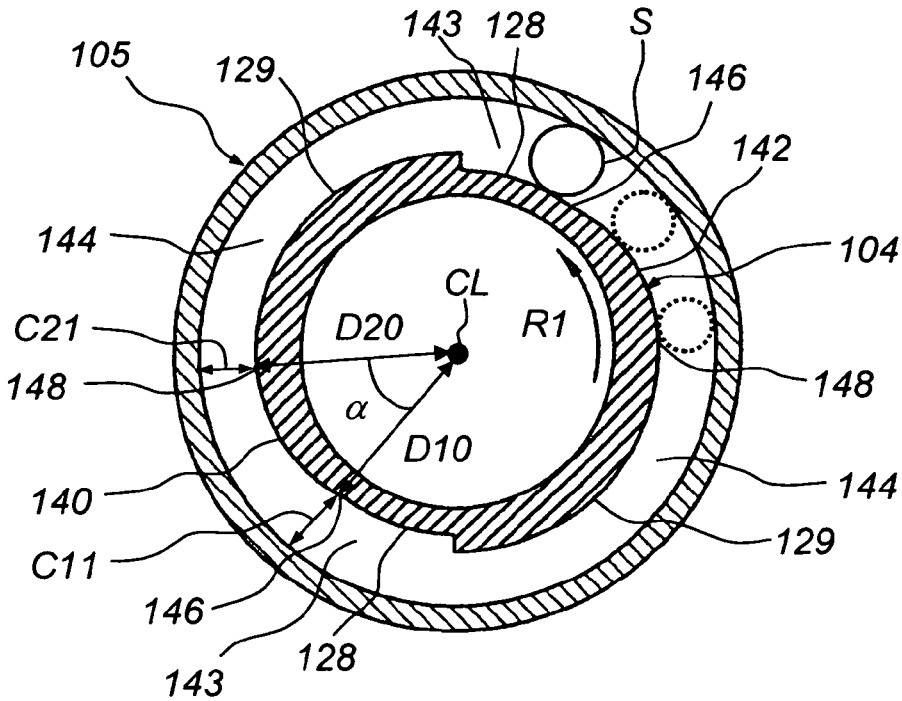
FIG. 6*a* is a section view in the horizontal plane and shows the inner shell shown in FIG. 5*a* in the section VIa-VIa as well as an outer shell.

FIG. 6*a* shows the inner shell 104 seen in the section VIa-VIa in FIG. 5*a*, i.e., in horizontal projection. For reasons of clarity, no subjacent structures are shown but only the structures that are in the proper section VIa-VIa. As is seen in FIG. 6*a*, also an outer shell 105 is shown as seen in cross-section on the same level as the inner shell 104. The design of and the function of the additional crusher surface 140 will now be described in more detail. The arrow shown in FIG. 6*a* shows how the inner shell 4, during crushing, will rotate in a first direction R1 around its own center axis CL. This rotation in the first direction R1 is the result of the rolling that has been described above. The additional crusher surface 140 has, in the horizontal projection shown in FIG. 6*a* and as seen in the first direction R1, a decreasing distance to the center axis CL. A first end 146 situated on the additional crusher surface 140, which end is situated in the downstream end in respect of the first direction R1, has a first distance D10 to the center axis CL. A second end 148 situated on the additional crusher surface 140, which end is situated in the upstream end in respect of the first direction R1, has a second distance D20 to the center axis CL, which second distance D20 is greater than the first distance D10. The first end 146 of the additional crusher surface 140 connects to the inner crusher surface 128, which thereby, to the center axis CL, will have the distance D10 that is constant on this height level. The second end 148 connects to the outer crusher surface 129, which thereby, to the center axis CL, also will have the distance D20 that is constant on this height level. Thus, the additional crusher surface 140 forms a smooth transition between the inner crusher surface 128 and the outer crusher surface 129, as seen in the first direction R1. D20 is approx. 10% longer than D10, which means that the crushing chamber 143 that is formed between the outer shell 105 and the inner crusher surface 128 is wider than the crushing chamber 144 that is formed between the outer shell 105 and the outer crusher surface 129. Thus, at the inner shell 104, the crushing gap in which material is crushed will be divided into a wider crushing chamber 143 and a thinner crushing chamber 144, which co-rotate with the rotation of the inner shell 104. Thereby, on the level shown in FIG. 6*a*, i.e., on a level with the upper portion 120 of the shell 104, during crushing, the crusher will have a first shell distance C11 occurring between the inner shell 104, at the first end 146 of the additional crusher surface 140, and the outer shell 105 that is approx. 1.3 times as large as a second shell distance C21 occurring between the inner shell 104, at the second end 148 of the additional crusher surface 140, and the outer shell 105. The additional crusher surface 140 extends, at the upper portion 120 of the shell 104, along approx. 40° of the circumference of the shell 104, i.e., the angle α shown in FIG. 6*a* is approx. 40°. The additional crusher surface 140 is arched and has more precisely a bulging arc-shape in relation to the center axis CL of the shell 104.

Figure 6B:
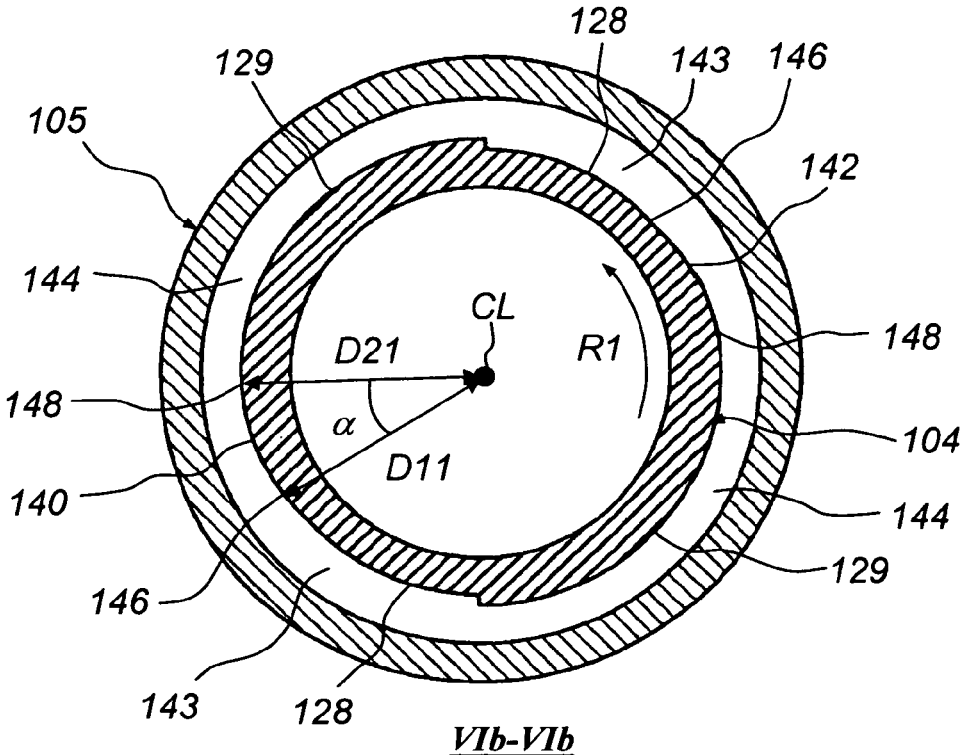
FIG. 6*b* is a section view in the horizontal plane and shows the inner shell shown in FIG. 5*a* in the section VIb-VIb as well as an outer shell.

FIG. 6*b* shows the inner shell 104 seen in the section VIb-VIb in FIG. 5*a*. The first end 146 situated on the additional crusher surface 140 has, on this level, a first distance D11 to the center axis CL. The second end 148 has, on this level, a second distance D21 to the center axis CL, which second distance D21 is greater than the first distance D11. D21 is approx. 5% longer than D11, which means that the crushing chamber 143 that is formed between the outer shell 105 and the inner crusher surface 128 is wider than the crushing chamber 144 that is formed between the outer shell 105 and the outer crusher surface 129. However, the difference between the distance D21 and the distance D11 is smaller than the difference between the distance D20 and the distance D10. Hence, the difference decreases between the first distance D10 and D11, respectively, and the second distance D20 and D21, respectively, with increasing distance from the upper portion 120 of the shell.

The additional crusher surface 140 extends, on the height level shown in FIG. 6*b*, along approx. 30° of the circumference of the shell 104, i.e., the angle α shown in FIG. 6*b* is approx. 30°.

Figure 6C:
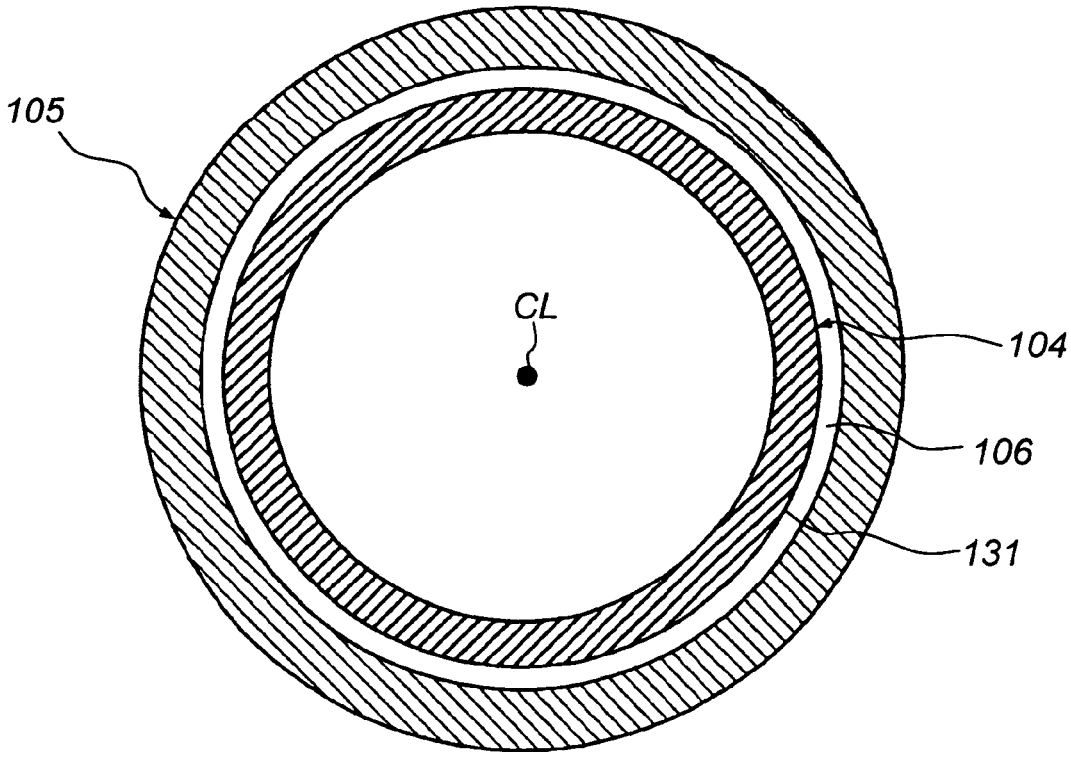
FIG. 6*c* is a section view in the horizontal plane and shows the inner shell shown in FIG. 5*a* in the section VIc-VIc as well as an outer shell.

FIG. 6*c* shows the inner shell 104 seen in the section VIc-VIc in FIG. 5*a*. As is seen, the shell 104 has, at this height level, only one crusher surface, viz. the lower crusher surface 131. Between the lower crusher surface 131 and the outer shell 105, a crushing gap 106 is formed. Thus, the difference between the first distance and the second distance has decreased to zero, the inner crusher surface and the outer crusher surface at a smooth transition having merged into each other with a smooth transition in order to jointly form the lower crusher surface 131.

Figure 7:
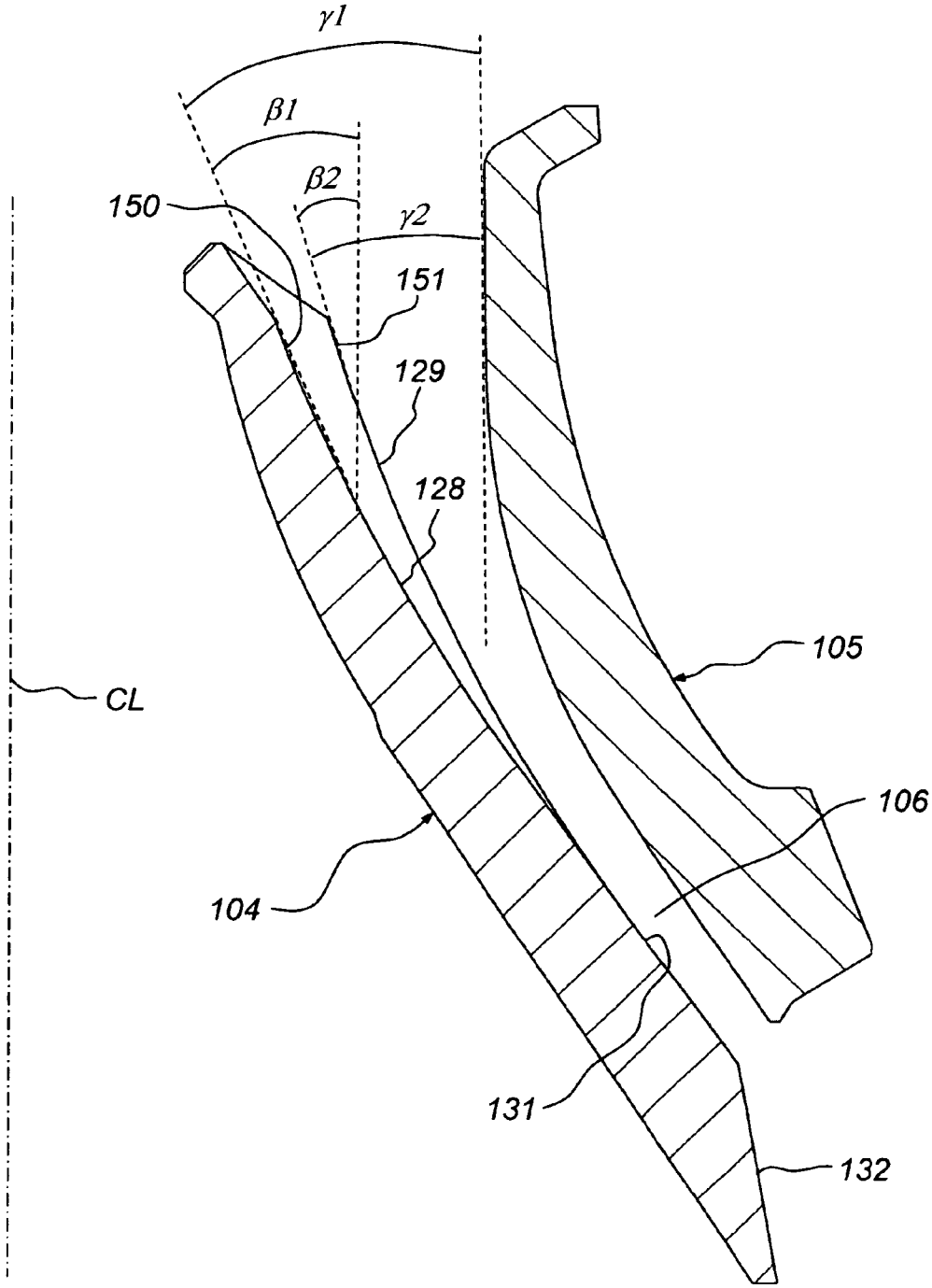
FIG. 7 is a section view in the vertical plane and shows the inner shell shown in FIG. 5*a* and an outer shell.

In FIG. 7, the inner shell 104 and the outer shell 105 are shown as seen in a section in vertical projection, corresponding to the section that is shown in FIG. 4. As is seen in FIG. 7, the inner crusher surface 128 slopes, at the upper portion thereof 150, inward toward the center axis CL. In that connection, the inner crusher surface 128 forms an angle β1 with the vertical plane of approx. 23°. Also the outer crusher surface 129 slopes at the upper portion thereof 151 inward toward the center axis CL and forms in that connection an angle β2 with the vertical plane of approx. 17°. The additional crusher surface 140, which is hidden in FIG. 7, forms a smooth transition between the inner crusher surface 128 and the outer crusher surface 129. The upper portion of the additional crusher surface 140 will in that connection also slope inward toward the center axis CL and form an angle with the vertical plane that runs from approx. 23° at the first end 146, next to the inner crusher surface 128, to approx. 17° at the second end 148, next to the outer crusher surface 129. On a level with the upper portion of the additional crusher surface 140, the crusher surface of the outer shell 105 is substantially vertical, as is seen in FIG. 7, and accordingly the additional crusher surface 140, seen in a radially vertical plane and on this level, will form an angle with the crusher surface of the outer shell 105 which runs from an angle γ1 of approx. 23° to an angle γ2 of approx. 17°. The additional crusher surface 142 has the same design as the additional crusher surface 140 described above.

The function of the additional crusher surfaces 140, 142 during crushing will now be described closer, reference being made to FIG. 6*a*, in which a stone block S is schematically shown. The stone block S has such size that it only can come down into the crushing chamber 143 that is formed between the inner crusher surface 128 and the outer shell 105. Due to the rolling, which causes rotation of the inner shell 104 in the first direction R1, the additional crusher surface 142 will travel along the stone block S in such a way that this is subjected to a thinner and thinner cross section from the first end 146 of the additional crusher surface 142 to the second end 148. The thinner and thinner cross section entails that the stone block S eventually is squeezed into pieces against the outer shell 105, indicated by dashed circles in FIG. 6*a*, which are so small that they also can be crushed in the thinner crushing chamber 144. It will be appreciated that the stone block S when being squeezed into pieces also successively will be moved vertically downward in the crusher.

Thus, the inner shell 104 allows a great part of the crossing operation, concerning the initially sufficiently small stone blocks as well as the stone block that have been squeezed into pieces by the additional crusher surfaces 140, 142, to take place in the thinner crushing chamber 144. This has the advantage that the wear of the lower crusher surface 131 decreases, which results in a longer service life of both the inner shell 104 and the outer shell 105. The wider crushing chamber 143 allows stone blocks, which are too large for the thinner crushing chamber 144, to be supplied down into the crusher and be crushed in the wider crushing chamber 143 and/or be squeezed into pieces by the additional crusher surfaces 140, 142. Thus, the additional crusher surfaces 140, 142, the inner crusher surfaces 128 and the outer crusher surfaces 129 entail that a supplied material, which contains an indefinite mixture of small and large objects can be crushed in the crusher, the small objects being crushed in the narrow crushing chamber 144 that is most suitable for the same and the large objects being crushed in the wider crushing chamber 143 that is most suitable for the same and/or are squeezed into pieces by the additional crusher surfaces 140, 142. The arc-shape of the additional crusher surfaces 140, 142, in combination with the large extension of each additional crusher surface 140, 142 over the circumference of the shell, i.e., the large angle α, has the advantage that the nip angles become advantageous, which decreases the risk that large stone blocks are pushed in front of the additional crusher surface 140, 142 instead of being supplied inward toward the second end 148 and be squeezed into pieces.

It will be appreciated that a large number of modifications of the embodiments described above are feasible within the scope of the invention, such as it is defined by the accompanying claims.

For instance, the additional crusher surfaces may have another shape than the bulging arc-shape described above. The additional crusher surfaces may, as seen in horizontal projection, e.g., be straight or have a curved-in arc-shape, in respect of the center axis. However, in most cases, the bulging arc-shape described above is preferable.

The number of additional crusher surfaces may be varied within wide limits. However, at least two additional crusher surfaces should normally be used and these should be symmetrically distributed around the circumference of the inner shell for avoidance of unbalances in the shell. However, it is also possible to use only 1 additional crusher surface, since the relatively low number of revolutions in a gyratory crusher makes that a certain imbalance frequently can be accepted. Usually, the number of additional crusher surfaces should be at most 8, even more preferred at most 6, since each additional crusher surface otherwise would become very short. Furthermore, in the case of too large a number of additional crusher surfaces, large objects are obstructed from coming down fast into the crushing gap.

In the example shown in FIG. 3, the first shell distance C1 in the crusher 1 is approx. three times as large as the second shell distance C2, i.e., the second shell distance C2 is approx. 33% of the first shell distance C1 on a level with the upper portion 20 of the inner shell 4. In the example shown in FIG. 6*a*, the second shell distance C21 is approx. 75% of the first shell distance C11 on a level with the upper portion 120 of the inner shell 104. It will be appreciated that the relation between the second shell distance C2 and the first shell distance C1 may be varied within wide limits. It has turned out that the second shell distance C2; C21 should be 10-90% of the first shell distance C1; C11, at least on a level with the upper portion of the inner shell, for the provision of an efficient squeezing of large objects without too great a mechanical load on the shaft 1' of the crusher 1 and the frame 16. It is even more preferred, in the embodiment shown in FIGS. 1-4 having additional crusher surfaces 40, 42, 44 formed on shoulders 34, 36, 38 that are carried by a shelf 26, that the second shell distance C2 is 10-60% of the first shell distance C1. In the embodiment shown in FIGS. 5-7, at the upper portion of the inner shell, the second shell distance C21 is suitably 40-90% of the first shell distance C11. As has been mentioned above, the shell distances relates to a neutral position, i.e., the shell distances have been measured at points on the inner shell, which points, in the moment of measuring, are halfway between the nearest position and the most remote position in relation to the outer shell.

The inner shell 4 shown in FIGS. 1-4 has 3 shelves 22, 24, 26. It will be appreciated that an inner shell may be provided with 1, 2, 3 or even more shelves. At least one shoulder having an additional crusher surface is formed on at least one of these shelves, but shoulders having additional crusher surfaces may also be formed on a plurality of shelves. Suitably, at least one shoulder is formed with an additional crusher surface on at least the lowermost shelf.

In the examples described above, in FIG. 3 and FIG. 6*a*, stone blocks S are indicated that have an approximately spherical shape. Tests have shown that the inner shells described above can squeeze stone blocks of substantially all shapes into pieces.

The inner shell 4 that is shown in FIGS. 1-4 has additional crusher surfaces 40, 42, 44, which are formed on shoulders 34, 36, 38 carried by a shelf 26. The inner shell 104 shown in FIGS. 5-7 has additional crusher surfaces 140, 142 that form transitions between inner crusher surfaces 128 and outer crusher surfaces 129. It is also possible to produce an inner shell, which in the upper portion thereof has a shelf carrying shoulders that have additional crusher surfaces according to the embodiment shown in FIGS. 1-4, and which furthermore, underneath the additional crusher surfaces according to FIGS. 1-4, has additional crusher surfaces according to FIGS. 5-7, which form transitions between inner crusher surfaces and outer crusher surfaces. Thus, it is possible to produce an inner shell that has additional crusher surfaces both of the type shown in FIGS. 1-4 and of the type shown in FIGS. 5-7. Such an inner shell can, in the upper portion thereof, having the additional crusher surfaces according to FIGS. 1-4, crush a few objects that are substantially larger than what the crushing gap is intended for, and, underneath said upper portion, by means of the additional crusher surfaces according to FIGS. 5-7 and the inner and outer crusher surfaces crush fine-grained as well as somewhat more coarse-grained material in the most efficient possible way.

It will be appreciated that the invention also may be applied on other types of crushers than the gyratory crusher described above that has a hydraulic regulation of the vertical position of the inner shell. The invention may also be applied to, among other things, crushers that have a mechanical setting of the gap between the inner and outer shell, for instance the type of crushers described in U.S. Pat. No. 1,894,601 to Symons. In the last-mentioned type of crushers, occasionally called Symons type, the setting of the gap between the inner and outer shell is carried out by the fact that a case, in which the outer shell is fastened, is threaded in a machine frame and turned in relation to the same for the achievement of the desired gap. In a variant of this type of crushers, instead of a thread, a number of hydraulic cylinders are utilized for the adjustment of the case in which the outer shell is fastened. The invention is applicable also to this type of crushers.

The first direction shown in FIG. 3 and FIGS. 6*a*-6*c* R1 is an anti-clockwise direction. It will be appreciated that the invention also relates to inner shells that have been formed in order to rotate in a first direction that is a clockwise direction.

While the invention has been disclosed with reference to certain preferred embodiments, numerous modifications, alterations, and changes to the described embodiments are possible without departing from the sphere and scope of the invention, as defined in the appended claims and their equivalents thereof. Accordingly, it is intended that the invention not be limited to the described embodiments, but that it have the full scope defined by the language of the following claims.

What is claimed is:

1. An inner shell for use in a gyratory crusher, which inner shell is intended to be brought into contact with a material that is supplied at the upper portion of the crusher and is to be crushed, and that in a crushing gap crush the same material against an outer shell, wherein the inner shell during crushing will rotate around its own center axis in a first direction, wherein the inner shell has at least one additional crusher surface, which, in horizontal projection and as seen in the first direction, has a decreasing distance to said center axis and which at a first end, which is situated at the downstream end of the additional crusher surface in respect of the first direction, is situated at a first distance from the center axis, and at a second end, which is situated at the upstream end of the additional crusher surface in respect of the first direction, is situated at a second distance from the center axis, which second distance is greater than said first distance, so that objects can be introduced between the additional crusher surface and the outer shell near said first end in order to, near said second end, be squeezed between the additional crusher surface and the outer shell and be crushed.

2. The inner shell according to claim 1, wherein the additional crusher surface, at least at the upper portion of the inner shell, extends around the circumference of the inner shell over an angle of at least 20°.

3. The inner shell according to claim 1, wherein the additional crusher surface is arched.

4. The inner shell according to claim 1, wherein the additional crusher surface, in relation to the center axis of the inner shell, has a bulging arc-shape.

5. The inner shell according to claim 1, wherein the inner shell is provided with up to eight additional crusher surfaces each one of which, in horizontal projection and as seen in the first direction, has a decreasing distance to said center axis.

6. The inner shell according to claim 5, which inner shell has at least two additional crusher surfaces, which are symmetrically distributed along the circumference of the inner shell.

7. The inner shell according to claim 1, wherein the additional crusher surface, as seen in vertical projection, at the upper portion thereof slopes inward toward the center axis of the inner shell.

8. The inner shell according to claim 7, wherein the additional crusher surface slopes inward toward the center axis of the inner shell at an angle in a range of 1-55° to the vertical plane, at least at the upper portion thereof.

9. The inner shell according to claim 1, wherein the inner shell has at least one shelf extending around the inner shell, a shoulder provided with the additional crusher surface being formed on said shelf.

10. The inner shell according to claim 9, wherein the shelf is placed in the upper portion of the inner shell.

11. The inner shell according to claim 1, wherein the additional crusher surface extends along a height in the vertical direction that is at least 40% of the total height in the vertical direction along which crushing of material takes place against the inner shell.

12. The inner shell according to claim 11, wherein the difference between said first distance and said second distance gradually decreases with increasing distance from the upper portion of the inner shell.

13. The inner shell according to claim 11, wherein the additional crusher surface forms a transition between a first circumference portion, which on each height level has a constant distance to said center axis, which distance is equal to the distance of the additional crusher surface at said first end to the center axis on the respective level, and a second circumference portion, which on each height level has a constant distance to said center axis, which distance is equal to the distance of the additional crusher surface at said second end to the center axis on the respective level.

14. The inner shell according to claim 1, wherein said second distance is 5-30% greater than said first distance, at least in the upper portion of the shell.

15. A gyratory crusher, which has an inner shell that is intended to be brought into contact with a material that is supplied at the upper portion of the crusher and is to be crushed, and that in a crushing gap crush the same material against an outer shell, wherein the inner shell during crushing will rotate around its own center axis in a first direction, wherein the inner shell has at least one additional crusher surface, which, in horizontal projection and as seen in the first direction, has a decreasing distance to said center axis and which at a first end, which is situated at the downstream end of the additional crusher surface in respect of the first direction, forms a first shell distance to the outer shell, and at a second end, which is situated at the upstream end of the additional crusher surface in respect of the first direction, forms a second shell distance to the outer shell, which second shell distance is smaller than said first shell distance, so that objects can be introduced between the additional crusher surface and the outer shell at said first end in order to, at said second end, be squeezed between the additional crusher surface and the outer shell and be crushed.

16. The gyratory crusher according to claim 15, wherein the second shell distance is 10-90% of the first shell distance, at least on a level with the upper portion of the inner shell, when the respective shell distance has been measured in a neutral position in relation to the outer shell.

17. The gyratory crusher according to claim 16, wherein the inner shell has at least one shelf extending around the inner shell, a shoulder provided with the additional crusher surface being formed on said shelf, the second shell distance being 10-60% of the first shell distance.

18. The gyratory crusher according to claim 16, wherein the additional crusher surface extends along a height in the vertical direction that is at least 40% of the total height in the vertical direction along which crushing of material takes place against the inner shell, the second shell distance being 40-90% of the first shell distance on a level with the upper portion of the inner shell.

19. The gyratory crusher according to claim 15, wherein the additional crusher surface, seen in a radially vertical plane and on a certain level in the vertical direction, forms an angle in a range of 1-30° with the crusher surface of the outer shell on the same level.

20. A gyratory crusher, comprising:

an inner shell having a center axis and defining a crusher surface disposed about the center axis, the inner shell being rotatable about the center axis in a first direction; and an outer shell defining a crushing gap with the inner shell;

wherein the inner shell defines at least one additional crusher surface, which, in horizontal projection and as viewed in the first direction, has a decreasing distance to the center axis and which, at a downstream end of the additional crusher surface with respect to the first direction, defines a first shell distance to the outer shell, and at an upstream end of the additional crusher surface with respect to the first direction, defines a second shell distance to the outer shell, the second shell distance being smaller than the first shell distance.

* * * * *